US012366012B2

(12) United States Patent
Xia et al.

(10) Patent No.: US 12,366,012 B2
(45) Date of Patent: Jul. 22, 2025

(54) ALGINATE FIBER AND PREPARATION METHOD THEREOF

(71) Applicant: QINGDAO UNIVERSITY, Qingdao (CN)

(72) Inventors: Yanzhi Xia, Qingdao (CN); Dagang Miao, Qingdao (CN); Kai Li, Qingdao (CN); Jiuyong Yao, Qingdao (CN); Fangfang Cheng, Qingdao (CN); Changhai Xu, Qingdao (CN)

(73) Assignee: QINGDAO UNIVERSITY, Qingdao (CN)

( * ) Notice: Subject to any disclaimer, the term of this patent is extended or adjusted under 35 U.S.C. 154(b) by 0 days.

(21) Appl. No.: 18/289,896

(22) PCT Filed: May 9, 2022

(86) PCT No.: PCT/CN2022/091698

§ 371 (c)(1),
(2) Date: May 13, 2024

(87) PCT Pub. No.: WO2022/237722

PCT Pub. Date: Nov. 17, 2022

(65) Prior Publication Data

US 2024/0328037 A1 Oct. 3, 2024

(30) Foreign Application Priority Data

May 12, 2021 (CN) ..... 202110516532.0

(51) Int. Cl.

| | |
|---|---|
| ***D01F 9/04*** | (2006.01) |
| ***D01D 5/02*** | (2006.01) |
| ***D01D 5/06*** | (2006.01) |
| ***D01D 10/06*** | (2006.01) |
| ***D01F 1/10*** | (2006.01) |
| ***D01F 11/02*** | (2006.01) |

(52) U.S. Cl.

CPC ..... *D01F 9/04* (2013.01); *D01D 5/02* (2013.01); *D01D 5/06* (2013.01); *D01D 10/06* (2013.01);

(Continued)

(58) Field of Classification Search

CPC ..... D01F 9/04; D01F 9/10; D01F 5/02; D01F 10/06; D01F 11/00; D06M 15/3562;

(Continued)

(56) References Cited

FOREIGN PATENT DOCUMENTS

| | | | |
|---|---|---|---|
| CN | 101070676 | A | 11/2007 |
| CN | 101081883 | A | 12/2007 |

(Continued)

OTHER PUBLICATIONS

Wentao Huang, et al., A Salt Controlled Scalable Approach for Formation of Polyelectrolyte Complex Fiber, Chinese Journal of Chemistry, 2020, pp. 465-470, vol. 38.

(Continued)

*Primary Examiner* — Camie S Thompson

(74) *Attorney, Agent, or Firm* — Bayramoglu Law Offices LLC

(57) ABSTRACT

An alginate fiber and a preparation method thereof are provided. The preparation method of the alginate fiber includes: S10: preparing a spinning solution with a raw material including sodium alginate; S20: extruding the spinning solution obtained in S10 into a solidification bath to allow solidification molding to obtain a primary fiber; S30: drawing and water-washing the primary fiber obtained in S20 to obtain an alginate fiber; and S40: soaking the alginate fiber obtained in S30 in a finishing agent to allow a post-treatment, where at least one of the raw material in S10, the solidification bath in S20, and the finishing agent in S30 includes a five-membered cyclic quaternary ammonium salt (Continued)

polymer. The alginate fiber obtained above has a high dye uptake, a small fiber strength loss, and a high soaping fastness.

9 Claims, 2 Drawing Sheets

(52) U.S. Cl.
CPC ..... *D01F 1/10* (2013.01); *D01F 11/02* (2013.01); *D10B 2201/20* (2013.01)

(58) Field of Classification Search
CPC . D06M 15/37; D06M 2101/04; D06P 1/5264; D10B 2201/01; D10B 2201/20
USPC ..... 428/364
See application file for complete search history.

(56) References Cited

FOREIGN PATENT DOCUMENTS

| | | | | |
|---|---|---|---|---|
| CN | 101381907 | A | | 3/2009 |
| CN | 101736440 | A | | 6/2010 |
| CN | 103981744 | | * | 8/2014 |
| CN | 106012103 | | * | 10/2016 |
| CN | 106498770 | A | | 3/2017 |
| CN | 108914630 | A | | 11/2018 |
| CN | 109183447 | A | | 1/2019 |
| CN | 113186739 | A | | 7/2021 |
| CN | 113249823 | A | | 8/2021 |
| CN | 113249986 | A | | 8/2021 |
| KR | 20100059171 | | * | 6/2010 |
| WO | 2012009363 | A1 | | 1/2012 |

OTHER PUBLICATIONS

GB/T 3921-2008, Textiles—Tests for colour fastness—Colour fastness to washing with soap or soap and soda, China National Standards, 2008, China Standard Press.

Liu Jie, et al., Study on dyeing process of alginate fibers with reactive dye, Textile Dyeing and Finishing Journal, 2014, pp. 11-13, vol. 36, No. 3.

Shao Huan-Ying, et al., Salt-free dyeing of calcium alginate fiber with direct dyes, Printing and Dyeing, 2014, pp. 1-5, No. 20.

* cited by examiner

ALGINATE FIBER AND PREPARATION METHOD THEREOF

CROSS REFERENCE TO THE RELATED APPLICATIONS

This application is the national phase entry of International Application No. PCT/CN2022/091698, filed on May 9, 2022, which is based upon and claims priority to Chinese Patent Application No. 202110516532.0, filed on May 12, 2021, the entire contents of which are incorporated herein by reference.

TECHNICAL FIELD

The present application belongs to the technical field of textile fabric dyeing, and specifically relates to an alginate fiber and a preparation method thereof.

BACKGROUND

Alginate fibers are a novel class of eco-friendly biodegradable fibers prepared by a wet spinning process with sodium alginate extracted from a natural seaweed as a raw material. Alginate fibers are valued for their excellent hygroscopicity, film-forming and fiber-forming properties, biodegradability, and biocompatibility.

Alginate fibers have been widely used in the field of medical dressings and also have great potential in superior-quality clothing, underwear fabrics, and decorative textiles.

A smooth feel of alginate fibers brings comfort to wearing but also difficulty to spinning. On the one hand, it is currently difficult to allow the preparation of a mono-fiber yarn from an alginate fiber alone by related technologies. On the other hand, because alginate fibers currently have a slightly high price, there are many alginate fiber-containing blended fabrics on the market.

Alginate fibers are often blended with cotton or wool, and the resulting blended fibers can have excellent wearability, such as bacteriostatic activity and flame retardance, which makes the blended fibers have promising industrial application prospects in the fields of clothing and industrial textiles.

However, alginate fibers have poor acid and alkali tolerance, and when encountering solutions of ammonium salts and $Na^+$, $K^+$, and $H^+$ ions, alginate fibers will swell or even be dissolved. As a result, it is extremely difficult to dye alginate fibers in the current dyeing system. The difficult dyeing of alginate fibers has become a bottleneck, limiting the large-scale application of alginate fibers in the textile field.

In related technologies, CN101736440A discloses a fabrication method for a dyeable alginate fiber. In this patent, a water-soluble dendritic macromolecule is added to an alginate fiber spinning solution, and with a wet spinning device and process, the resulting mixture is subjected to solidification, drawing, water-washing, and a post-treatment to obtain the dyeable alginate fiber. A key to this method is the addition of a polyamide (PA)-amine dendritic macromolecule to the spinning solution, which makes it fail to solve the strong electronegativity of alginate fibers; and during dyeing, a salt needs to be added to promote dyeing, which inevitably causes damage to alginate fibers.

In addition, a preparation method for alginate fiber is reported in the paper "Salt-Free Dyeing of Calcium Alginate Fiber with Direct Dye (*China Dyeing & Finishing*, October 2014, 1-5) issued by Huanying SHAO et al. and the paper "Research on Dyeing Process of Alginate Fiber with Reactive Dye (*Textile Dyeing and Finishing Journal*, March 2014, 11-13) issued by Jie LIU et al. In both of the papers, calcium chloride is used, where in the former, calcium chloride is used as a dye-fixing agent, and in the latter, calcium chloride is used as a dyeing accelerant. When used as a dye-fixing agent, calcium chloride will make a fiber brittle and easy to break. When calcium chloride is used as a dyeing accelerant, as mentioned in the paper, the strength of a fiber decreases very significantly, with a decrease of about 30% to 40%.

Currently, some salt-free cotton dyeing processes cannot be used for dyeing alginate fibers due to various limitations. In CN108914630A, a pretreatment solution with a caustic soda concentration of 2 g/L to 6 g/L is adopted, and this process will make an alginate fiber substantially dissolved. For example, in CN106498770A, cotton is modified with an adsorbent cationic modifier instead of caustic soda. However, an obvious linear quaternary ammonium salt macromolecule has a poor adsorption and crosslinking effect with alginate fibers, which will also cause the swelling and dissolution of alginate fibers, thereby affecting the service performance of alginate fibers.

In summary, it is highly desirable for those skilled in the art to find a preparation method for an alginate fiber that allows the easy dyeing of the alginate fiber without destroying the morphological structure of the alginate fiber and reducing its strength.

SUMMARY

The present application is intended to provide an alginate fiber and a preparation method thereof to solve the technical problem of difficult dyeing of alginate fibers in the prior art.

To solve the above technical problem, the present application is implemented as follows:

The present application provides a preparation method for an alginate fiber, including:

S10: preparing a spinning solution with a raw material including sodium alginate;

S20: extruding the spinning solution obtained in S10 into a solidification bath to allow solidification molding to obtain a primary fiber;

S30: drawing and water-washing the primary fiber obtained in S20 to obtain an alginate fiber; and S40: soaking the alginate fiber obtained in S30 in a finishing agent to allow a post-treatment, where at least one or all of the raw material in S10, the solidification bath in S20, and the finishing agent in S30 include(s) a five-membered cyclic quaternary ammonium salt polymer.

In addition, the technical solution provided by the above embodiment of the present application may also have the following additional technical features:

In the above technical solution, the five-membered cyclic quaternary ammonium salt polymer is

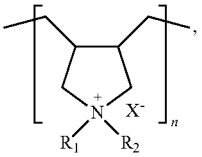

where $R_1$ is $CH_3$ or $CHCH_3$ or $CH_2(CH_2)_4CH_3$ or $CH_2(CH_2)_{10}CH_3$ or $CH_2(CH_2)_{16}CH_3$ or $C_6H_5CH_2$, $R_2$ is $CH_3$ or $CH_2CH_3$ or $CH_2(CH_2)_4CH_3$ or $CH_2(CH_2)_{10}CH_3$ or $CH_2(CH_2)_{16}CH_3$ or $C_6H_5CH_2$, and a degree of polymerization (DP) n ranges from 50 to 25,000.

In the above technical solution, a mass percentage content of the five-membered cyclic quaternary ammonium salt polymer in the alginate fiber is 0.1% to 10%.

In the above technical solution, S10 specifically includes:

S101: mixing sodium alginate with a five-membered cyclic quaternary ammonium salt polymer in water to obtain a spinning solution, where a mass ratio of the sodium alginate to the five-membered cyclic quaternary ammonium salt polymer is 100:(0.001-30).

In the above technical solution, a mass percentage concentration of the sodium alginate in the spinning solution is 3% to 6%.

In the above technical solution, S20 specifically includes:

S201: allowing the spinning solution obtained in S10 to stand for deaeration, and then extruding the spinning solution into a solidification bath at 40° C. to 70° C. to allow solidification molding, where the solidification bath includes the five-membered cyclic quaternary ammonium salt polymer with a mass percentage concentration of 0.01% to 2%. And/or In the above technical solution, S40 specifically includes:

S401: soaking the alginate fiber obtained in S30 in a finishing agent at 20° C. to 70° C. to allow a post-treatment for 5 min to 60 min, where the finishing agent includes the five-membered cyclic quaternary ammonium salt polymer, and a mass of the five-membered cyclic quaternary ammonium salt polymer is 0.5% to 10% of a mass of the alginate fiber obtained in S30.

In the above technical solution, in S20, a pH of the solidification bath is 4.5 to 6.5.

In the above technical solution, in S20, the solidification bath is a calcium chloride aqueous solution with a mass percentage concentration of 1% to 6%.

In the above technical solution, after S40, the preparation method further includes:

S50: washing and oven-drying an alginate fiber obtained in S40.

The present application also provides an alginate fiber prepared by the preparation method described in the above technical solution.

The present application has the following beneficial effects:

1. An alginate fiber prepared by the preparation method provided in the present application has a high dye uptake, a low fiber strength loss rate, and a high soaping fastness. Thus, the present application can lead to a brightly-colored alginate fiber.
2. The preparation method for the alginate fiber provided in the present application will not destroy a morphological structure of the alginate fiber, and the alginate fiber can be dyed in a non-salt and non-alkali system, which protects the alginate fiber to the greatest extent.
3. In the preparation method for the alginate fiber provided in the present application, a spinning cross-linking process and a post-finishing process are adopted, and appropriate raw materials, proportions, and reaction conditions are selected to construct a quaternary ammonium-based chromophore inside and on a surface of an alginate fiber to obtain a dyeable alginate fiber, which solves the bottleneck problem of the current industrial application of alginate fibers.

Additional aspects and advantages of the present application will be partly provided in the following description, and partly become evident in the following description or understood through the practice of the present application.

DETAILED DESCRIPTION OF THE EMBODIMENTS

Figure 1:
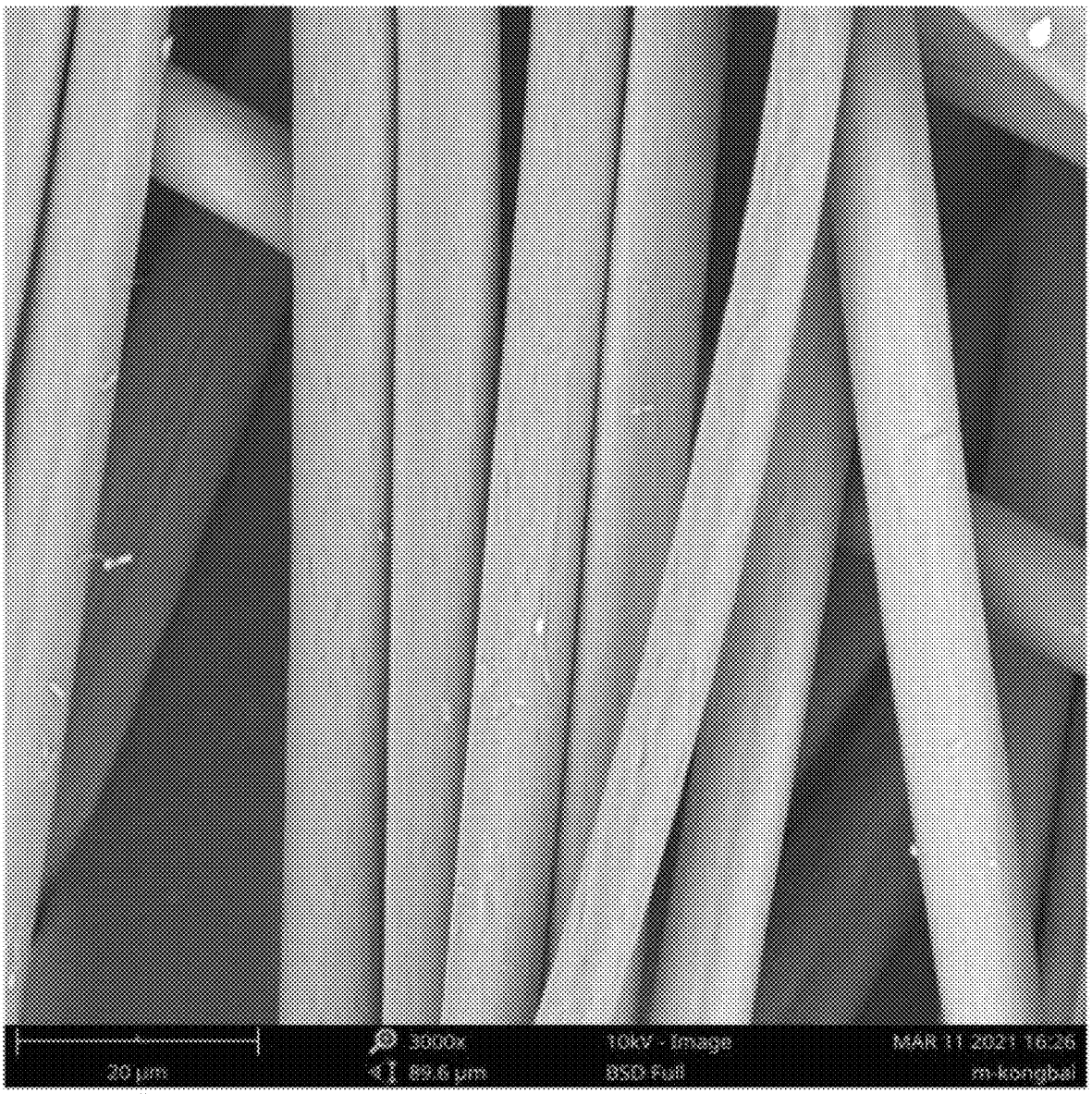
FIG. 1 (Prior art)
FIG. 1 is a scanning electron microscopy (SEM) image of an alginate fiber in the prior art.

The embodiments described below with reference to the accompanying drawings are exemplary, and are merely intended to explain the present application, rather than to limit the present application. All other embodiments obtained by those of ordinary skill in the art based on the embodiments of the present application without creative efforts should fall within the protection scope of the present application.

An embodiment of the present application provides a preparation method for an alginate fiber, including:

S10: a spinning solution is prepared with a raw material including sodium alginate;

S20: the spinning solution obtained in S10 is extruded into a solidification bath to allow solidification molding to obtain a primary fiber;

S30: the primary fiber obtained in S20 is drawn and water-washed to obtain an alginate fiber; and S40: the alginate fiber obtained in S30 is soaked in a finishing agent to allow a post-treatment, where at least one or all of the raw material in S10, the solidification bath in S20, and the finishing agent in S30 include(s) a five-membered cyclic quaternary ammonium salt polymer.

In the above embodiment, the alginate fiber obtained in the embodiment of the present application may be used to prepare an alginate fiber-containing blended fabric, and the alginate fiber-containing blended fabric is a blended fabric of the alginate fiber with one or more other fibers. For example, the alginate fiber-containing blended fabric can be at least one of an alginate fiber/cotton blended fabric, an alginate fiber/rayon blended fabric, an alginate fiber/wool blended fabric, an alginate fiber/cashmere blended fabric, and an alginate fiber/silk blended fabric.

In the above embodiment, the alginate fiber obtained in the embodiment of the present application can be easily dyed to have a bright color. One or more of a direct dye, an acidic dye, a reactive dye, a natural dye, and an indigo dye is/are selected for dyeing.

In the above embodiment, making at least one or all of the raw material in S10, the solidification bath in S20, and the finishing agent in S30 include a five-membered cyclic quaternary ammonium salt polymer is intended to improve a dye uptake of the alginate fiber during dyeing, reduce a loss rate of the alginate fiber, and improve a soaping fastness of the alginate fiber. The alginate fiber-containing blended fabric obtained by the preparation method provided in the embodiment of the present application has a dye uptake of greater than or equal to 85% and a soaping fastness of greater than or equal to grade 4.

A principle that the embodiment of the present application can allow the above objective is as follows: Sodium alginate is a block linear polysaccharide obtained by linking two uronic acids with different structures through C-1,4 bonds, namely, β-D-mannuronic acid (referred to as unit M) and α-L-guluronic acid (referred to as unit G). These two structural units in a sodium alginate molecule are distributed in a molecular chain in the forms of polymannuronic acid (M)n and polyguluronic acid (G)n, and the two structural units are linked through alternative M and G or poly(MG)n and have chemical structures as follows:

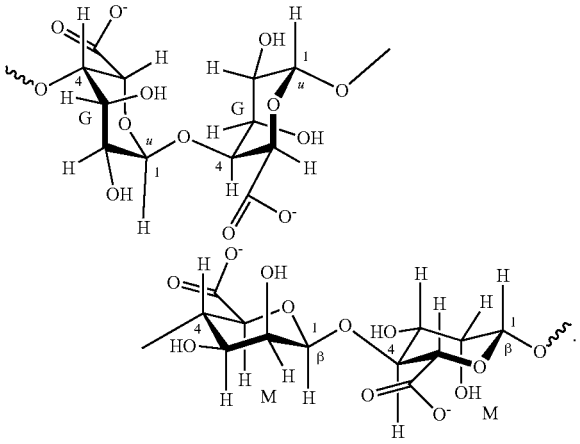

When encountering a calcium chloride-containing solidification bath, the sodium alginate-containing spinning solution will be quickly transformed into a water-insoluble calcium alginate gel. This process is mainly characterized by the formation of an "egg-shell" structure by a GG chain segment and $Ca^{2+}$ to produce the alginate fiber. Many monovalent salts destroy the stability of the alginate fiber, that is, an "egg-shell" cross-linked structure of the alginate fiber is destroyed.

One of the keys to the present application is that at least one or all of the raw material in S10, the solidification bath in S20, and the finishing agent in S30 include(s) a five-membered cyclic quaternary ammonium salt polymer. By adding the five-membered cyclic quaternary ammonium salt polymer during different processes (one or more steps) of spinning, the alginate fiber can be provided with quaternary ammonium-based chromophores. The five-membered cyclic quaternary ammonium salt polymer of the embodiment of the present application has a similar structure to the M unit of the alginate fiber, has excellent planarity, is easy to adsorb and cross-link with the M unit, and has a low probability of replacing $Ca^{2+}$. Due to a high cation density, the five-membered cyclic quaternary ammonium salt polymer of the embodiment of the present application can adsorb different alginate fiber macromolecular chains and ultimately assist the "egg-shell" system to form a stable dyeable alginate fiber system, and can also ensure the stability and mechanical properties of the alginate fiber as much as possible.

In summary, the alginate fiber of the embodiment of the present application has excellent dyeability, and can be subjected to salt-free dyeing with a commercial direct dye. The dyeable alginate fiber produced by adding the five-membered cyclic quaternary ammonium salt polymer during spinning in the embodiment of the present application can be dyed to have a bright color, with an excellent fastness. During dyeing, the alginate fiber can retain its original morphology, and undergoes no obvious dissolution and no significant mechanical performance degradation.

In addition, in the preparation method for a dyeable alginate fiber proposed in the related technology such as CN101736440A, a dendritic macromolecule is added to a spinning raw material to provide a chromophore, but the problem of electronegativity of the fiber cannot be solved. However, in the embodiment of the present application, during the spinning and post-treatment, the five-membered cyclic quaternary ammonium salt polymer is added to solve the problems of stable chromophores and electronegativity of the dyeable alginate fiber.

In some implementations of the embodiment of the present application, the five-membered cyclic quaternary ammonium salt polymer is

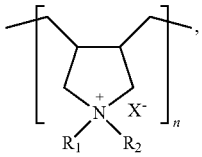

where $R_1$ is $CH_3$ or $CH_2CH_3$ or $CH_2(CH_2)_4CH_3$ or $CH_2(CH_2)_{10}CH_3$ or $CH_2(CH_2)_{16}CH_3$ or $C_6H_5CH_2$, $R_2$ is $CH_3$ or $CH_2CH_3$ or $CH_2(CH_2)_4CH_3$ or $CH_2(CH_2)_{10}CH_3$ or $CH_2(CH_2)_{16}CH_3$ or $C_6H_5CH_2$, and a DP n ranges from 50 to 25,000.

In some implementations of the embodiment of the present application, the five-membered cyclic quaternary ammonium salt polymer is a water-soluble five-membered cyclic quaternary ammonium salt polymer.

In some implementations of the embodiment of the present application, a mass percentage content of the five-membered cyclic quaternary ammonium salt polymer in the alginate fiber is 0.1% to 10%.

In some implementations of the embodiment of the present application, a mass percentage content of the five-membered cyclic quaternary ammonium salt polymer in the alginate fiber is 2% to 8%.

In some implementations of the embodiment of the present application, a mass percentage content of the five-membered cyclic quaternary ammonium salt polymer in the alginate fiber is 4% to 6%. In some implementations of the embodiment of the present application, a mass percentage content of the five-membered cyclic quaternary ammonium salt polymer in the alginate fiber is 5%.

In some implementations of the embodiment of the present application, the five-membered cyclic quaternary ammonium salt polymer is prepared by the following method: a five-membered cyclic quaternary ammonium salt monomer, an initiator, and ethylenediaminetetraacetic acid disodium ($EDTA\text{-}Na_2$) are mixed, and a resulting mixture is incubated at 60° C. to 100° C. for 1 h to 5 h to obtain the five-membered cyclic quaternary ammonium salt polymer.

In some implementations of the embodiment of the present application, the five-membered cyclic quaternary ammonium salt polymer is prepared by the following method: a five-membered cyclic quaternary ammonium salt monomer, an initiator, and $EDTA\text{-}Na_2$ are mixed, and a resulting mixture is incubated at 70° C. to 90° C. for 2 h to 3 h to obtain the five-membered cyclic quaternary ammonium salt polymer.

In some implementations of the embodiment of the present application, the five-membered cyclic quaternary ammonium salt polymer is prepared by the following method: a five-membered cyclic quaternary ammonium salt monomer, an initiator, and EDTA-$Na_2$ are mixed, and a resulting mixture is incubated at 80° C. to 85° C. for 2.5 h to obtain the five-membered cyclic quaternary ammonium salt polymer.

In the above implementations, a reactor equipped with a stirrer, a thermometer, and a nitrogen introduction device is used to prepare the five-membered cyclic quaternary ammonium salt polymer.

In the above implementations, a concentration of the five-membered cyclic quaternary ammonium salt monomer is 20% to 80%, a concentration of the initiator is 0.1% to 2%, and a concentration of the EDTA-$Na_2$ is 0.001% to 0.01%.

In the above implementations, a concentration of the five-membered cyclic quaternary ammonium salt monomer is 40% to 60%, a concentration of the initiator is 1% to 1.5%, and a concentration of the EDTA-$Na_2$ is 0.004% to 0.006%.

In the above implementations, the initiator includes any one or more of potassium persulfate, sodium persulfate, ammonium persulfate, azodiisobutamidine hydrochloride, azodiisobutyronitrile, and azobisisoheptonitrile.

In the above implementations, a specific preparation method for the five-membered cyclic quaternary ammonium salt polymer is as follows: 20% to 80% of the five-membered cyclic quaternary ammonium salt monomer is added to the reactor equipped with a stirrer, a thermometer, and a nitrogen introduction device, and then 0.1% to 2% of the initiator and 0.001% to 0.01% of the EDTA-$Na_2$ are added successively; and nitrogen is then introduced for 20 min to 40 min, and a resulting mixture is heated to 60° C. to 100° C. and then kept at this temperature for 1 h to 5 h to obtain the five-membered cyclic quaternary ammonium salt polymer.

In some implementations of the embodiment of the present application, S10 specifically includes:

S101: sodium alginate is mixed with a five-membered cyclic quaternary ammonium salt polymer in water to obtain a spinning solution, where a mass ratio of the sodium alginate to the five-membered cyclic quaternary ammonium salt polymer is 100:(0.001-30).

In some implementations of the embodiment of the present application, S10 specifically includes:

S101: sodium alginate is mixed with a five-membered cyclic quaternary ammonium salt polymer in water to obtain a spinning solution, where a mass ratio of the sodium alginate to the five-membered cyclic quaternary ammonium salt polymer is 100:(10-20).

In some implementations of the embodiment of the present application, S10 specifically includes:

S101: sodium alginate is mixed with a five-membered cyclic quaternary ammonium salt polymer in water to obtain a spinning solution, where a mass ratio of the sodium alginate to the five-membered cyclic quaternary ammonium salt polymer is 100:(12-18).

In some implementations of the embodiment of the present application, a mass percentage concentration of the sodium alginate in the spinning solution is 3% to 6%.

In some implementations of the embodiment of the present application, a mass percentage concentration of the sodium alginate in the spinning solution is 4% to 5%.

In some implementations of the embodiment of the present application. S20 specifically includes:

S201: the spinning solution obtained in S10 is allowed to stand for deaeration, and then extruded into a solidification bath at 40° C. to 70° C. to allow solidification molding.

In some implementations of the embodiment of the present application, S20 specifically includes:

S201: the spinning solution obtained in S10 is allowed to stand for deaeration, and then extruded into a solidification bath at 50° C. to 60° C. to allow solidification molding.

In some implementations of the embodiment of the present application, the solidification bath includes the five-membered cyclic quaternary ammonium salt polymer with a mass percentage concentration of 0.01% to 2%.

In some implementations of the embodiment of the present application, the solidification bath includes the five-membered cyclic quaternary ammonium salt polymer with a mass percentage concentration of 0.5% to 1.5%.

In some implementations of the embodiment of the present application, the solidification bath includes the five-membered cyclic quaternary ammonium salt polymer with a mass percentage concentration of 1%.

In some implementations of the embodiment of the present application, S40 specifically includes:

S401: the alginate fiber obtained in S30 is soaked in a finishing agent at 20° C. to 70° C. to allow a post-treatment for 5 min to 60 min.

In some implementations of the embodiment of the present application, S40 specifically includes:

S401: the alginate fiber obtained in S30 is soaked in a finishing agent at 40° C. to 50° C. to allow a post-treatment for 20 min to 40 min.

In some implementations of the embodiment of the present application, the finishing agent includes the five-membered cyclic quaternary ammonium salt polymer, and a mass of the five-membered cyclic quaternary ammonium salt polymer is 0.5% to 10% of a mass of the alginate fiber obtained in S30.

In some implementations of the embodiment of the present application, the finishing agent includes the five-membered cyclic quaternary ammonium salt polymer, and a mass of the five-membered cyclic quaternary ammonium salt polymer is 2% to 8% of a mass of the alginate fiber obtained in S30.

In some implementations of the embodiment of the present application, the finishing agent includes the five-membered cyclic quaternary ammonium salt polymer, and a mass of the five-membered cyclic quaternary ammonium salt polymer is 4% to 6% of a mass of the alginate fiber obtained in S30.

In some implementations of the embodiment of the present application, in S20, a pH of the solidification bath is 4.5 to 6.5.

In some implementations of the embodiment of the present application, in S20, a pH of the solidification bath is 5.

In some implementations of the embodiment of the present application, in S20, the solidification bath is a calcium chloride aqueous solution with a mass percentage concentration of 1% to 6%.

In some implementations of the embodiment of the present application, in S20, the solidification bath is a calcium chloride aqueous solution with a mass percentage concentration of 2% to 4%.

In some implementations of the embodiment of the present application, after S40, the preparation method further includes:

S50: an alginate fiber obtained in S40 is washed and oven-dried.

Example 1

(1) 40 g of sodium alginate and 1 g of a five-membered cyclic quaternary ammonium salt polymer modifier were prepared into 1,000 g of a spinning solution.

(2) An aqueous solution including 5% (mass percentage) of calcium chloride and 1% (mass percentage) of the five-membered cyclic quaternary ammonium salt polymer modifier was prepared as a solidification bath, and a pH of the solidification bath was adjusted with hydrochloric acid to 5; and the spinning solution was allowed to stand for deaeration and then extruded into the solidification bath at 40° C. to allow solidification molding, and a resulting alginate fiber was drawn and rinsed.

(3) 1 g of the five-membered cyclic quaternary ammonium salt polymer modifier was dissolved in water to prepare 1,000 g of a soaking solution; and the alginate fiber obtained in step (2) was soaked in the soaking solution at 30° C. for 20 min, then rinsed, and dried to obtain a post-treated cross-linked alginate fiber.

Example 2

(1) 100 g of sodium alginate was dissolved in water to prepare 2,000 g of a spinning solution.

(2) An aqueous solution including 6% (mass percentage) of calcium chloride and 1.5% (mass percentage) of the five-membered cyclic quaternary ammonium salt polymer modifier was prepared as a solidification bath, and a pH of the solidification bath was adjusted with hydrochloric acid to 6; and the spinning solution was allowed to stand for deaeration and then extruded into the solidification bath at 40° C. to allow solidification molding, and a resulting alginate fiber was drawn and rinsed.

(3) 6 g of the five-membered cyclic quaternary ammonium salt polymer modifier was dissolved in water to prepare 1,000 g of a soaking solution; and the alginate fiber obtained in step (2) was soaked in the soaking solution at 40° C. for 10 min, then rinsed, and dried to obtain a post-treated cross-linked alginate fiber.

Example 3

(1) 300 g of sodium alginate was dissolved in water to prepare 4,000 g of a spinning solution.

(2) An aqueous solution including 4.5% (mass percentage) of calcium chloride was prepared as a solidification bath, and a pH of the solidification bath was adjusted with hydrochloric acid to 5; and the spinning solution was allowed to stand for deaeration and then extruded into the solidification bath at 55° C. to allow solidification molding, and a resulting alginate fiber was drawn and rinsed.

(3) 9 g of the five-membered cyclic quaternary ammonium salt polymer modifier was dissolved in water to prepare 6000 g of a soaking solution; and the alginate fiber obtained in step (2) was soaked in the soaking solution at 50° C. for 8 min, then rinsed, and dried to obtain a post-treated cross-linked alginate fiber.

For comparison, an ordinary polyquaternary ammonium salt compound that does not have a five-membered ring is adopted as an example in the present application.

Example 4

(1) 40 g of sodium alginate and 1 g of a diaminourea polymer were prepared into 1,000 g of a spinning solution.

(2) An aqueous solution including 5% (mass percentage) of calcium chloride and 1% (mass percentage) of the diaminourea polymer was prepared as a solidification bath, and a pH of the solidification bath was adjusted with hydrochloric acid to 5; and the spinning solution was allowed to stand for deaeration and then extruded into the solidification bath at 40° C. to allow solidification molding, and a resulting alginate fiber was drawn and rinsed.

(3) 1 g of the diaminourea polymer was dissolved in water to prepare 1,000 g of a soaking solution; and the alginate fiber obtained in step (2) was soaked in the soaking solution at 30° C. for 20 min, then rinsed, and dried to obtain a post-treated cross-linked alginate fiber.

Figure 2:
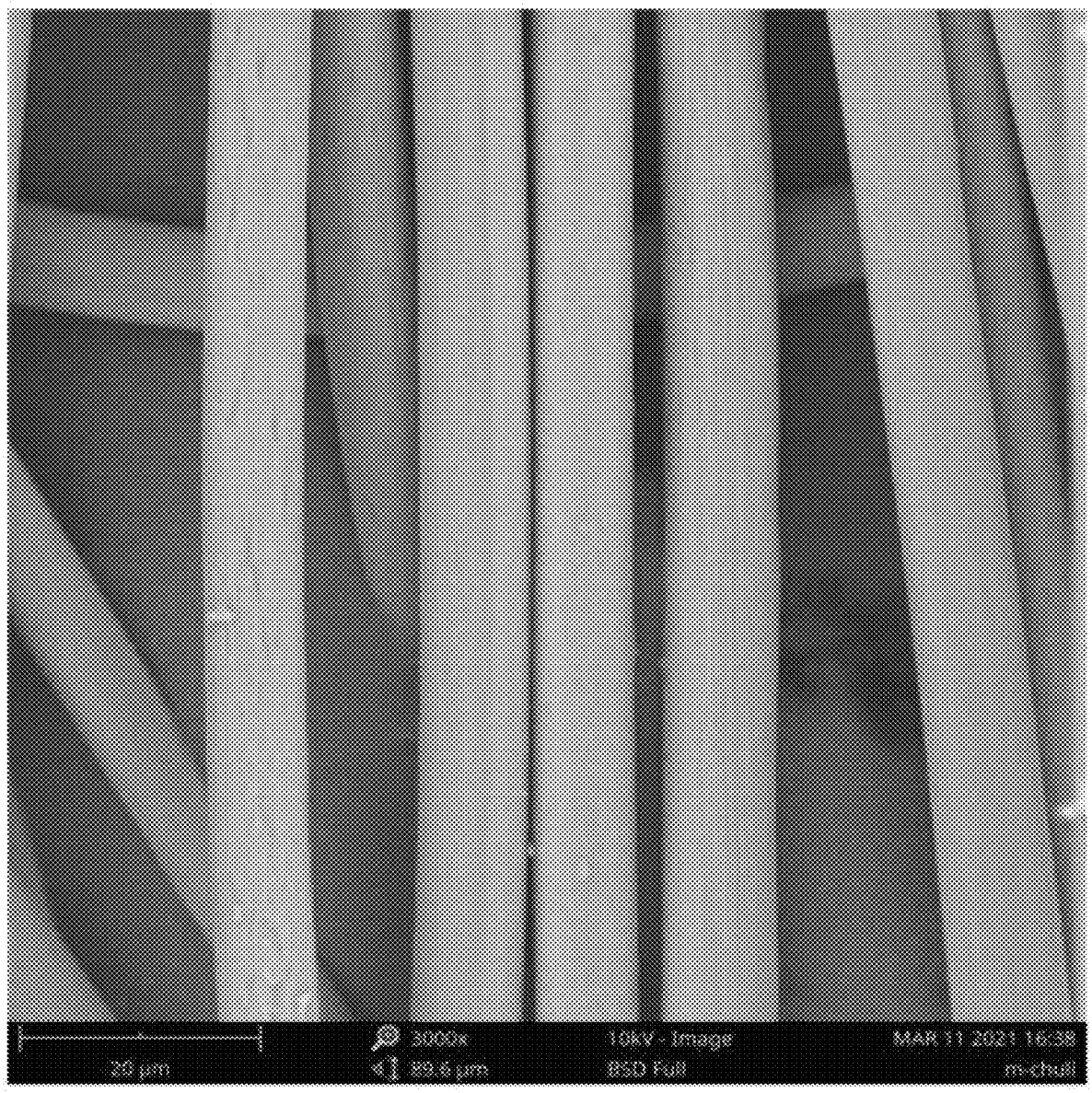
FIG. 2 is an SEM image of the alginate fiber provided in the present application.

FIG. 1 is an SEM image of the conventional alginate fiber and FIG. 2 is an SEM image of the dyeable alginate fiber. Dyeing properties of the ordinary alginate fiber and the dyeable alginate fibers obtained in Examples 1, 2, 3, and 4 were shown in Table 1.

TABLE 1

Properties of the ordinary alginate fiber and the dyeable alginate fibers

| | Dye uptake (%) | | | |
|---|---|---|---|---|
| Sample | Direct scarlet 4BS | Direct yellow RS | Direct blue 3RL | Breaking strength |
| Ordinary alginate fiber | 4.6 | 5.3 | 4.2 | 3.51 |
| Example 1 | 85.5 | 86.9 | 86.3 | 3.52 |
| Example 2 | 88.9 | 87.6 | 88.5 | 3.50 |
| Example 3 | 91.2 | 90.3 | 90.4 | 3.53 |
| Example 4 | 34.6 | 36.6 | 37.6 | 2.43 |

A dyeing process for the alginate fibers in the examples of the present application was as follows: 0.2 g of a direct dye (direct scarlet 4BS, direct yellow RS, or direct blue 3RL) was weighed and added to 400 g of water, a resulting mixture was stirred for dissolution, then 10 g of an alginate fiber was added at room temperature, and a resulting system was heated at 2° C./min to 80° C. to allow dyeing for 40 min; and then the alginate fiber was washed in a 5 g/L neutral detergent aqueous solution at 90° C. for 10 min, then cooled, washed with water, and then oven-dried at 80° C. or air-dried.

With reference to the national standard "GB/T3921-2008 Textile Color Fastness Test-Soaping Fastness", a soaping fastness of a fiber was tested. Soaping fastnesses of the alginate fibers obtained in Examples 1, 2, 3, and 4 to direct scarlet 4BS, direct yellow RS, and direct blue 3RL all reach or exceed grade 4.

The terms such as "first" and "second" used in the specification and claims of the present application may explicitly or implicitly include one or more corresponding features. In the description of the present application, unless otherwise specified, "a plurality of" means two or more. In addition, "and/or" in the specification and claims indicates at least one of the connected objects, and the character "/" generally indicates an "or" relationship between associated objects.

In the description of this specification, the description with reference to the terms "one embodiment", "some embodiments", "an illustrative embodiment", "an example", "a specific example", or "some examples" means that specific features, structures, materials, or characteristics described with reference to the embodiment or example are included in at least one embodiment or example of the present application. In this specification, the schematic representations of the above terms do not necessarily refer to the same embodiment or example. In addition, the specific features, structures, materials, or characteristics described may be combined in any suitable manner in any one or more embodiments or examples.

Although the embodiments of the present application have been illustrated and described, a person of ordinary skill in the art can understand that various changes, modifications, replacements, and variants may be made to these embodiments without departing from the principle and purpose of the present application, and the scope of the present application is defined by the claims and equivalents thereof.

What is claimed is:

1. A preparation method for an alginate fiber, comprising:

S10: mixing sodium alginate with a five-membered cyclic quaternary ammonium salt polymer in water to obtain a spinning solution, wherein a mass ratio of the sodium alginate to the five-membered cyclic quaternary ammonium salt polymer is 100:(0.001-30);

S20: allowing the spinning solution obtained in S10 to stand for deaeration, and then extruding the spinning solution into a solidification bath at 40° C. to 70° C. to allow solidification molding to obtain a primary fiber, wherein the solidification bath comprises the five-membered cyclic quaternary ammonium salt polymer with a mass percentage concentration of 0.01% to 2%;

S30: drawing and water-washing the primary fiber obtained in S20 to obtain an alginate fiber; and S40: soaking the alginate fiber obtained in S30 in a finishing agent at 20° C. to 70° C. for 5 min to 60 min, wherein the finishing agent comprises the five-membered cyclic quaternary ammonium salt polymer, and a mass of the five-membered cyclic quaternary ammonium salt polymer is 0.5% to 10% of a mass of the alginate fiber obtained in S30; and the five-membered cyclic quaternary ammonium salt polymer is

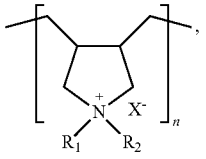

wherein R1 is CH3 or CH2CH3 or CH2(CH2)4CH3 or CH2(CH2)10CH3 or CH2(CH2)16CH3 or C6H5CH2, R2 is CH3 or CH2CH3 or CH2(CH2)4CH3 or CH2(CH2) 10CH3 or CH2(CH2)16CH3 or C6H5CH2, and a degree of polymerization (DP) n ranges from 50 to 25,000.

2. The preparation method for the alginate fiber according to claim 1, wherein a mass percentage content of the five-membered cyclic quaternary ammonium salt polymer in the alginate fiber is 0.1% to 10%.

3. The preparation method for the alginate fiber according to claim 2, wherein in S20, a pH of the solidification bath is 4.5 to 6.5; and/or in S20, the solidification bath further comprises a calcium chloride aqueous solution with a mass percentage concentration of 1% to 6%.

4. The preparation method for the alginate fiber according to claim 2, wherein after S40, the preparation method further comprises: S50: washing and oven-drying the alginate fiber obtained in S40.

5. The preparation method for the alginate fiber according to claim 1, wherein a mass percentage concentration of the sodium alginate in the spinning solution is 3% to 6%.

6. The preparation method for the alginate fiber according to claim 5, wherein in S20, a pH of the solidification bath is 4.5 to 6.5; and/or in S20, the solidification bath further comprises a calcium chloride aqueous solution with a mass percentage concentration of 1% to 6%.

7. The preparation method for the alginate fiber according to claim 5, wherein the alginate fiber is washed and dried.

8. The preparation method for the alginate fiber according to claim 1, wherein in S20, a pH of the solidification bath is 4.5 to 6.5; and/or in S20, the solidification bath further comprises a calcium chloride aqueous solution with a mass percentage concentration of 1% to 6%.

9. The preparation method for the alginate fiber according to claim 1, wherein after S40, the preparation method further comprises: S50: washing and oven-drying the alginate fiber obtained in S40.

* * * * *